US007837748B2

(12) United States Patent
Ketley et al.

(10) Patent No.: US 7,837,748 B2
(45) Date of Patent: Nov. 23, 2010

(54) COMPOSITION FOR BLENDING OF TRANSPORTATION FUELS

(75) Inventors: Graham W. Ketley, Naperville, IL (US); Michael Hodges, Wonersh (GB)

(73) Assignee: BP Corporation North America Inc., Warrenville, IL (US)

( * ) Notice: Subject to any disclaimer, the term of this patent is extended or adjusted under 35 U.S.C. 154(b) by 1014 days.

(21) Appl. No.: 11/532,241

(22) Filed: Sep. 15, 2006

(65) Prior Publication Data

US 2007/0033859 A1 Feb. 15, 2007

Related U.S. Application Data

(62) Division of application No. 10/279,406, filed on Oct. 24, 2002, now Pat. No. 7,541,502.

(51) Int. Cl.
*C10L 1/18* (2006.01)

(52) U.S. Cl. ..... 44/393; 585/14

(58) Field of Classification Search ..... 585/14; 44/393

See application file for complete search history.

(56) References Cited

U.S. PATENT DOCUMENTS

| | | | | |
|---|---|---|---|---|
| 2,204,215 | A | | 6/1940 | Greensfelder et al. |
| H1305 | H | * | 5/1994 | Townsend et al. ..... 44/449 |
| 5,599,441 | A | | 2/1997 | Collins et al. |

FOREIGN PATENT DOCUMENTS

| | | |
|---|---|---|
| CA | 2 393 280 | 6/2001 |
| JP | 2001-123186 | 5/2001 |
| JP | 2001-192688 | 7/2001 |
| WO | WO 96/17810 | 6/1996 |
| WO | WO 98/30655 | 7/1998 |
| WO | WO 99/09117 | 2/1999 |
| WO | WO 00/14182 | 3/2000 |
| WO | WO 00/78897 | 12/2000 |

OTHER PUBLICATIONS

Takashi, K., "A Market Research Result for Gasoline Quality, Niseki Review," vol. 40, No. 3, pp. 26-52, Aug. 1998.

* cited by examiner

*Primary Examiner*—Cephia D Toomer
(74) *Attorney, Agent, or Firm*—Ekkehard Schoettle

(57) ABSTRACT

Disclosed are fuel compositions for internal combustion engines comprising as a predominant component organic distillates which exhibit suitable physical properties, and a low-sulfur fraction of an alkylated petroleum feedstock which, for example, consisted of material boiling between about 60° C. and about 345° C. More particularly, compositions of the invention comprise low-boiling, low-sulfur, blending components, advantageously obtained by a process for converting sulfur-containing organic compounds which are unwanted impurities, to higher boiling products by alkylation and removing the higher boiling products by fractional distillation. Products can be used directly as transportation fuels and/or blending components to provide fuels which are more friendly to the environment.

9 Claims, 5 Drawing Sheets

COMPOSITION FOR BLENDING OF TRANSPORTATION FUELS

The present application claims the benefit of U.S. Provisional Application No. 60/334,769 filed on Oct. 25, 2001.

TECHNICAL FIELD

The present invention relates to compositions of fuels for transportation which are liquid at ambient conditions, and are typically derived from natural petroleum. Broadly, it relates to compositions comprising as a predominant component organic distillates which exhibit suitable physical properties, and a low-sulfur fraction of an alkylated petroleum feedstock which, for example, consisted of material boiling between about 60° C. and about 345° C. More particularly, the invention relates to low-boiling, low-sulfur, blending components of fuels for internal combustion engines, advantageously obtained by a process for converting sulfur-containing organic compounds which are unwanted impurities, to higher boiling products by alkylation and removing the higher boiling products by fractional distillation. Products can be used directly as transportation fuels and/or blending components to provide fuels which are more friendly to the environment.

BACKGROUND OF THE INVENTION

It is well known that internal combustion engines have revolutionized transportation following their invention during the last decades of the 19th century. While others, including Benz and Gottleib Wilhelm Daimler, invented and developed engines using electric ignition of fuel such as gasoline, Rudolf C. K. Diesel invented and built the engine named for him which employs compression for auto-ignition of the fuel in order to utilize low-cost organic fuels. Equal, if not more important, development of improved spark-ignition engines, diesel engines and other types of internal combustion engines for use in transportation has proceeded hand-in-hand with improvements in fuel compositions. Modern high performance engines of all types demand ever more advanced specification of fuel compositions, but cost remains an important consideration.

At the present time most fuels for transportation are derived from natural petroleum. Indeed, petroleum as yet is the world's main source of hydrocarbons used as fuel and petrochemical feedstock. While compositions of natural petroleum or crude oils are significantly varied, all crudes contain sulfur compounds and most contain nitrogen compounds which may also contain oxygen, but oxygen content of most crudes is low. Generally, sulfur concentration in crude is less than about 8 percent, with most crudes having sulfur concentrations in the range from about 0.5 to about 1.5 percent. Nitrogen concentration is usually less than 0.2 percent, but it may be as high as 1.6 percent.

Crude oil seldom is used in the form produced at the well, but is converted in oil refineries into a wide range of fuels and petrochemical feedstocks. Typically fuels for transportation are produced by processing and blending of distilled fractions from the crude to meet the particular end use specifications. Because most of the crudes available today in large quantity are high in sulfur, the distilled fractions must be desulfurized to yield products which meet performance specifications and/or environmental standards. Sulfur containing organic compounds in fuels continue to be a major source of environmental pollution. During combustion they are converted to sulfur oxides which, in turn, give rise to sulfur oxyacids and, also, contribute to particulate emissions.

Even in newer, high performance diesel engines combustion of conventional fuel produces smoke in the exhaust. Oxygenated compounds and compounds containing few or no carbon-to-carbon chemical bonds, such as methanol and dimethyl ether, are known to reduce smoke and engine exhaust emissions. However, most such compounds have high vapor pressure and/or are nearly insoluble in diesel fuel, and they have poor ignition quality, as indicated by their cetane numbers. Furthermore, other methods of improving diesel fuels by chemical hydrogenation to reduce their sulfur and aromatics contents, also causes a reduction in fuel lubricity. Diesel fuels of low lubricity may cause excessive wear of fuel injectors and other moving parts which come in contact with the fuel under high pressures.

In the face of ever-tightening sulfur specifications in transportation fuels, sulfur removal from petroleum feedstocks and products will become increasingly important in years to come. While legislation on sulfur in diesel fuel in Europe, Japan and the U.S. has recently lowered the specification to 0.05 percent by weight (max.), indications are that future specifications may go far below the current 0.05 percent by weight level. Legislation on sulfur in gasoline in the U.S. now limits each refinery to an average of 30 parts per million. In and after 2006 the average specification will be replaced by a cap of 80 parts per million maxim.

The fluidized catalytic cracking process is one of the major refining processes which is currently employed in the conversion of petroleum to desirable fuels such as gasoline and diesel fuel. In this process, a high molecular weight hydrocarbon feedstock is converted to lower molecular weight products through contact with hot, finely-divided, solid catalyst particles in a fluidized or dispersed state. Suitable hydrocarbon feedstocks typically boil within the range of 205° C. to about 650° C., and they are usually contacted with the catalyst at temperatures in the range 450° C. to about 650° C. Suitable feedstocks include various mineral oil fractions such as light gas oils, heavy gas oils, wide-cut gas oils, vacuum gas oils, kerosenes, decanted oils, residual fractions, reduced crude oils and cycle oils which are derived from any of these as well as fractions derived from shale oils, tar sands processing, and coal liquefaction. Products from a fluidized catalytic cracking process are typically based on boiling point and include light naphtha (boiling between about 10° C. and about 221° C.), heavy naphtha (boiling between about 10° C. and about 249° C.), kerosene (boiling between about 180° C. and about 300° C.), light cycle oil (boiling between about 221 ° C. and about 345° C.), and heavy cycle oil (boiling at temperatures higher than about 345° C.).

Not only does the fluidized catalytic cracking process provide a significant part of the gasoline pool in the United States, it also provides a large proportion of the sulfur that appears in this pool. The sulfur in the liquid products from this process is in the form of organic sulfur compounds and is an undesirable impurity which is converted to sulfur oxides when these products are utilized as a fuel. These sulfur oxides are objectionable air pollutants. In addition, they can deactivate many of the catalysts that have been developed for the catalytic converters which are used on automobiles to catalyze the conversion of harmful engine exhaust emissions to gases which are less objectionable. Accordingly, it is desirable to reduce the sulfur content of catalytic cracking products to the lowest possible levels.

The sulfur-containing impurities of straight run gasolines, which are prepared by simple distillation of crude oil, are usually very different from those in cracked gasolines. The former contain mostly mercaptans and sulfides, whereas the latter are rich in thiophene, benzothiophene and derivatives of thiophene and benzothiophene.

Low sulfur products are conventionally obtained from the catalytic cracking process by hydrotreating either the feedstock to the process or the products from the process. Hydrotreating involves treatment of products of the cracking process with hydrogen in the presence of a catalyst and results in the conversion of the sulfur in the sulfur-containing impurities to hydrogen sulfide, which can be separated and converted to elemental sulfur. Unfortunately, this type of processing is typically quite expensive because it requires a source of hydrogen, high pressure process equipment, expensive hydrotreating catalysts, and a sulfur recovery plant for conversion of the resulting hydrogen sulfide to elemental sulfur. In addition, the hydrotreating process can result in an undesired destruction of olefins in the feedstock by converting them to saturated hydrocarbons through hydrogenation. This destruction of olefins by hydrogenation is usually undesirable because it results in the consumption of expensive hydrogen, and also because the olefins are valuable as high octane components of gasoline. As an example, naphtha of a gasoline boiling range from a catalytic cracking process has a relatively high octane number as a result of a large olefin content. Hydrotreating such a material causes a reduction in the olefin content in addition to the desired desulfurization, and the octane number of the hydrotreated product decreases as the degree of desulfurization increases.

Conventional hydrodesulfurization catalysts can be used to remove a major portion of the sulfur from petroleum distillates for the blending of refinery transportation fuels, but they are not efficient for removing sulfur from compounds where the sulfur atom is sterically hindered as in multi-ring aromatic sulfur compounds. This is especially true where the sulfur heteroatom is doubly hindered (e.g., 4,6-dimethyldibenzothiophene). Using conventional hydrodesulfurization catalysts at high temperatures would cause yield loss, faster catalyst coking, and product quality deterioration (e.g., color). Using high pressure requires a large capital outlay. Accordingly, there is a need for an inexpensive process for the effective removal of sulfur-containing impurities from distillate hydrocarbon liquids. There is also a need for such a process which can be used to remove sulfur-containing impurities from distillate hydrocarbon liquids, such as products from a fluidized catalytic cracking process, which are highly olefinic and contain both thiophenic and benzothiophenic compounds as unwanted impurities.

In order to meet stricter specifications in the future, such hindered sulfur compounds will also have to be removed from distillate feedstocks and products. There is a pressing need for economical removal of sulfur from refinery fuels for transportation, especially from components for gasoline, jet fuels and Diesel fuels.

There is, therefore, a present need for catalytic processes to prepare products of reduced sulfur content from a feedstock wherein the feedstock is comprised of limited amounts of sulfur-containing and/or nitrogen-containing organic compounds as unwanted impurities, in particular, processes which do not have the above disadvantages. A further object of the invention is to provide inexpensive processes for the efficient removal of impurities from a hydrocarbon feedstock.

This invention is directed to overcoming the problems set forth above in order to provide components for refinery blending of transportation fuels friendly to the environment.

SUMMARY OF THE INVENTION

In one aspect, this invention provides composition for fuel or blending component of fuels which are liquid at ambient conditions, which composition comprises: as a predominant component organic distillates, which predominant component exhibits a suitable initial boiling point and contains less than 50 ppm sulfur (preferably less than 30 ppm sulfur, and more preferably less than 15 ppm sulfur); and one or more aromatic compound represented by the formula

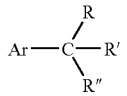

where Ar is an aryl moiety of 6 or 7 carbon atoms, R is hydrogen or an alkane group of 1 or 2 carbon atoms, and R' and R" are each an independently selected alkane group of from 1 to 4 carbon atoms. In preferred aspects of the invention, the total number of carbon atoms of R, R' and R" is from 4 to 7 carbon atoms.

In typical compositions according to the invention, the predominant component is a mixture of organic compounds derived from natural petroleum, and further comprise an effective amount of one or more fuel additives which enhance desired fuel properties.

Beneficially, the aromatic compounds represented by the formula are in an amount of from about 0.01 percent to about 10 percent based upon the total weight of aromatic compounds in the fuel. The aromatic compounds represented by the formula preferably comprise at least aryl moiety selected from the group consisting of benzo, tolyl, phenyl and phenylene, and more preferably the aromatic compounds represented by the formula comprise at least aryl moiety selected from the group consisting of benzo, tolyl and phenyl.

In one aspect of the invention the total amount of the aromatic compounds in the fuel increases the initial boiling point such that $$[10^\circ\ \text{C.}+(IBP)_{composition}]>(IBP)_{distillates},$$

where $(IBP)_{composition}$ is, the initial boiling point of the composition and $(IBP)_{distillates}$, is the initial boiling point of the distillates.

Other aspects of the invention include compositions wherein the total amount of aromatic compounds in the fuel is no more than 35 percent by volume, and the amount of alkene compounds in the fuel is no more than 15 percent by volume.

Other aspects of the invention include compositions wherein the total amount of aromatic compounds in the fuel is no larger than 25 percent by volume, and the amount of alkene compounds in the fuel is no more than 6 percent by volume.

Another aspect of the invention is a composition of fuel suitable for use in compression ignition internal combustion engines, which fuel comprises: as a predominant component a mixture of organic compounds exhibiting a suitable initial boiling point, and containing one or more aromatic compound represented by the formula

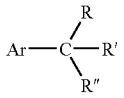

where Ar is an aryl moiety of 6 or 7 carbon atoms, R is hydrogen or an alkane group of 1 or 2 carbon atoms, and R' and R" are each an independently selected alkane group of from 1 to 4 carbon atoms, the aromatic compounds represented by the formula are from about 0.01 percent to about 20 percent by weight of all aromatic compounds in the fuel, and wherein the fuel exhibits a suitable flash point of at least 38° C. as measure by ASTM D93, and contains less than 50 ppm sulfur. Preferred are fuels which exhibit a suitable flash point of at least 49° C. sulfur.

Preferred compositions according to the invention further comprising an effective amount of one or more Diesel fuel additives selected from the group consisting of copolymers of ethylene and vinyl acetate, which enhances cold flow properties of Diesel fuel.

Yet another aspect of the invention is a fuel composition suitable for use in spark ignition internal combustion engines, comprising: as a predominant component organic distillates, and one or more aromatic compound represented by the formula

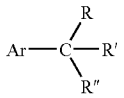

where Ar is an aryl moiety of 6 or 7 carbon atoms, R is hydrogen or an alkane group of 1 or 2 carbon atoms, and R' and R" are each an independently selected alkane group of from 1 to 4 carbon atoms, the aromatic compounds represented by the formula are from about 0.01 percent to about 20 percent by weight of all aromatic compounds in the fuel, and wherein the fuel exhibits a suitable flash point of at least 38° C. as measure by ASTM D93, and wherein the fuel exhibits a suitable Reid vapor pressure of at least 6 psi and contains less than 50 ppm sulfur.

Aspects of the invention having special significance include a fuel composition suitable for use in spark ignition internal combustion engines, the fuel composition comprising: as a predominant component an organic distillate comprising hydrocarbon compounds boiling in a temperature range of from about 30° C. to about 230° C.; and a low-sulfur fraction as by distillation of an alkylated petroleum feedstock which consisted of material boiling between about 60° C. and about 345° C.

In preferred embodiments of the invention, the feedstock is comprised of a naphtha from a catalytic cracking process, and/or the feedstock is comprised of a naphtha from a thermal cracking process. Advantageously the low-sulfur fraction contains less than about 30 parts per million of sulfur.

In other preferred embodiments of the invention, the a low-sulfur fraction is obtained by a process which comprises: (A) providing a feedstock comprising a mixture of hydrocarbons which includes olefins and sulfur-containing organic compounds, the feedstock consisting essentially of material boiling between about 60° C. and about 345° C. and having a sulfur content up to about 5,000 parts per million; (B) in at least one contacting stage at elevated temperatures, contacting the feedstock with an acidic catalyst under conditions which are effective to convert a portion of the impurities to a sulfur-containing material of higher boiling point through alkylation by the olefins, thereby forming a product stream; and (C) fractionating the subsequent product stream by distillation to provide at least one low-boiling, low-sulfur fraction consisting of a sulfur-lean fraction having a sulfur content less than about 50 parts per million, and a high-boiling fraction consisting of a sulfur-rich, fraction containing the balance of the sulfur. Beneficially the high-boiling fraction has a distillation end point which is below about 249° C.

In other aspects of the invention the petroleum feedstock comprises alkene compounds having from 4 to about 6 carbon atoms, including, as a reactive class of alkene compounds, trans and cis butene-2, pentene-1, trans and cis pentene-2, 2-methyl butene-1, 2-methyl butene-2, 2-methyl pentene-1, and 2-methyl pentene-2, and the amount of this reactive class is from about 40 to about 60 percent by weight of the alkene compounds having from 4 to about 6 carbon atoms.

In other preferred embodiments of the invention, the alkylated petroleum feedstock comprises alkene compounds having from 4 to about 6 carbon atoms, in which the alkene compounds, trans and cis butene-2, pentene-1, trans and cis pentene-2, 2-methyl butene-1, 2-methyl butene-2, 2-methyl pentene-1, and 2-methyl pentene-2, and they amount to less than about 40 percent by weight of the alkene compounds having from 4 to about 6 carbon atoms.

Advantageously, the low-sulfur fraction has a distillation end point in the range from about 80° C. to about 220° C. and/or the low-sulfur fraction has a distillation end point of less than about 110° C.

In other aspects of the invention the low-sulfur fraction comprises alicyclic compounds having from 4 to about 8 carbon atoms, including alicyclic compounds having at least one double bond in the ring, and wherein the fuel composition comprises from about 0.01 percent to about 1.0 percent by weight of a class of cycloolefins having from 5 to about 7 carbon atoms. Preferably the class of cycloolefins includes cyclopentene, cyclohexene, and cycloheptene.

In yet other aspects of the invention the alkylated petroleum distillate comprises one or more aromatic compound represented by the formula

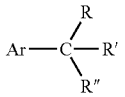

where Ar is an aryl moiety of 6 or 7 carbon atoms, R is hydrogen or an alkane group of 1 or 2 carbon atoms, and R' and R" are each an independently selected alkane group of from 1 to 4 carbon atoms.

In other aspects of the invention the aromatic compounds represented by the formula are from about 0.01 percent to about 20 percent by weight of all aromatic compounds in the fuel In other aspects of the invention the fuel exhibits a suitable flash point of at least 38° C. as measure by ASTM D93, and wherein the fuel exhibits a suitable Reid vapor pressure of at least 6 psi and contains less than 50 ppm sulfur.

In other aspects of the invention the low-sulfur fraction the low-sulfur fraction has a final boiling point of less than about 110° C. as measured by ASTM D86.

Other aspects of the invention include compositions formed by any process disclosed herein. Such compositions have a sulfur content of less than about 50 parts per million, preferably less than about 30 parts per million, more preferably have a sulfur content of less than about 15 parts per million, and most preferably less than about 10 parts per million.

For a more complete understanding of the present invention, reference should now be made to the embodiments illustrated in greater detail in the accompanying drawing and described below by way of examples of the invention.

BRIEF DESCRIPTION OF THE DRAWING

The drawings are bar charts depicting preferred aspects of compositions of the present invention.

GENERAL DESCRIPTION

Figure 1:
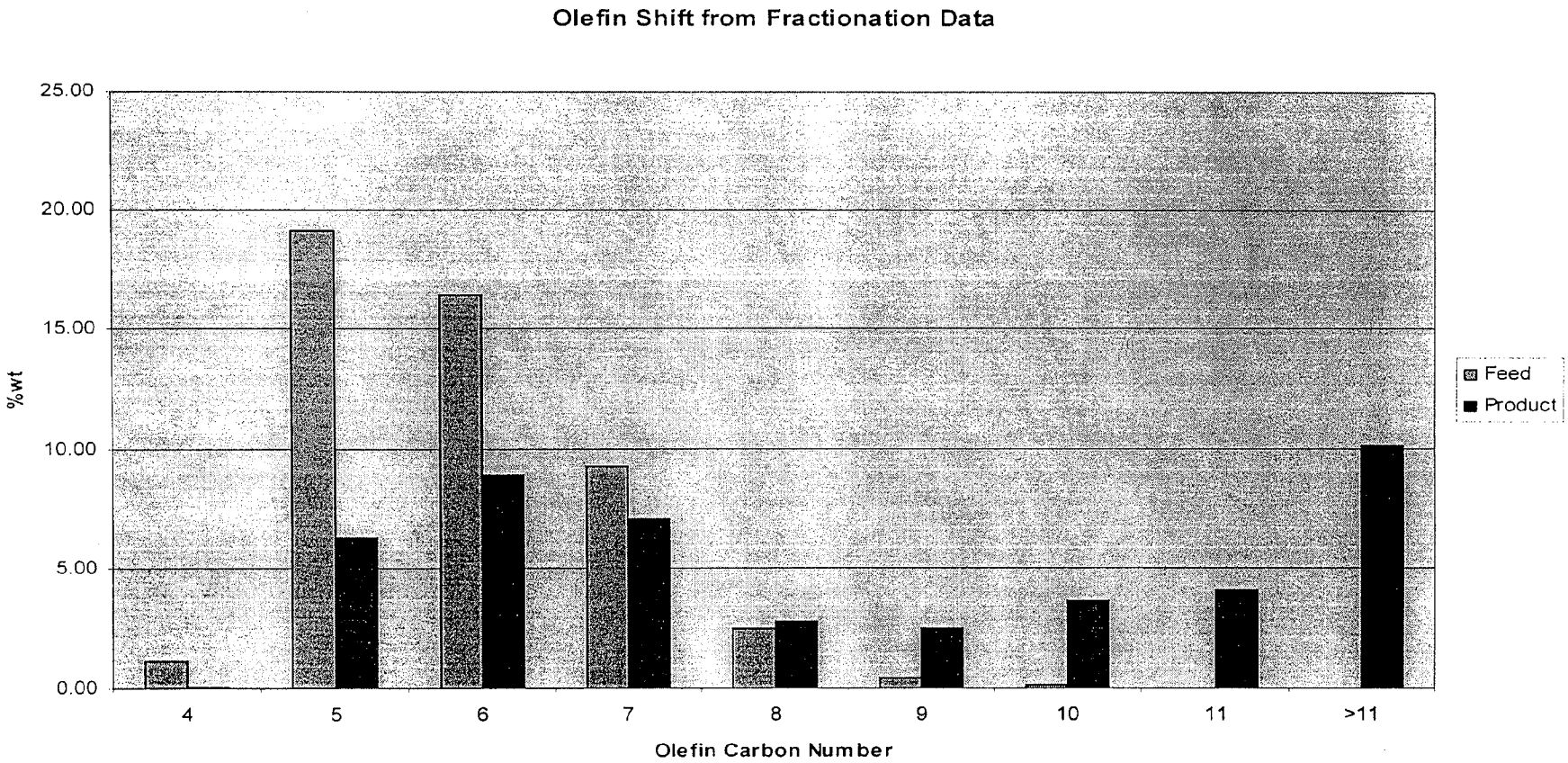
Figure 2:
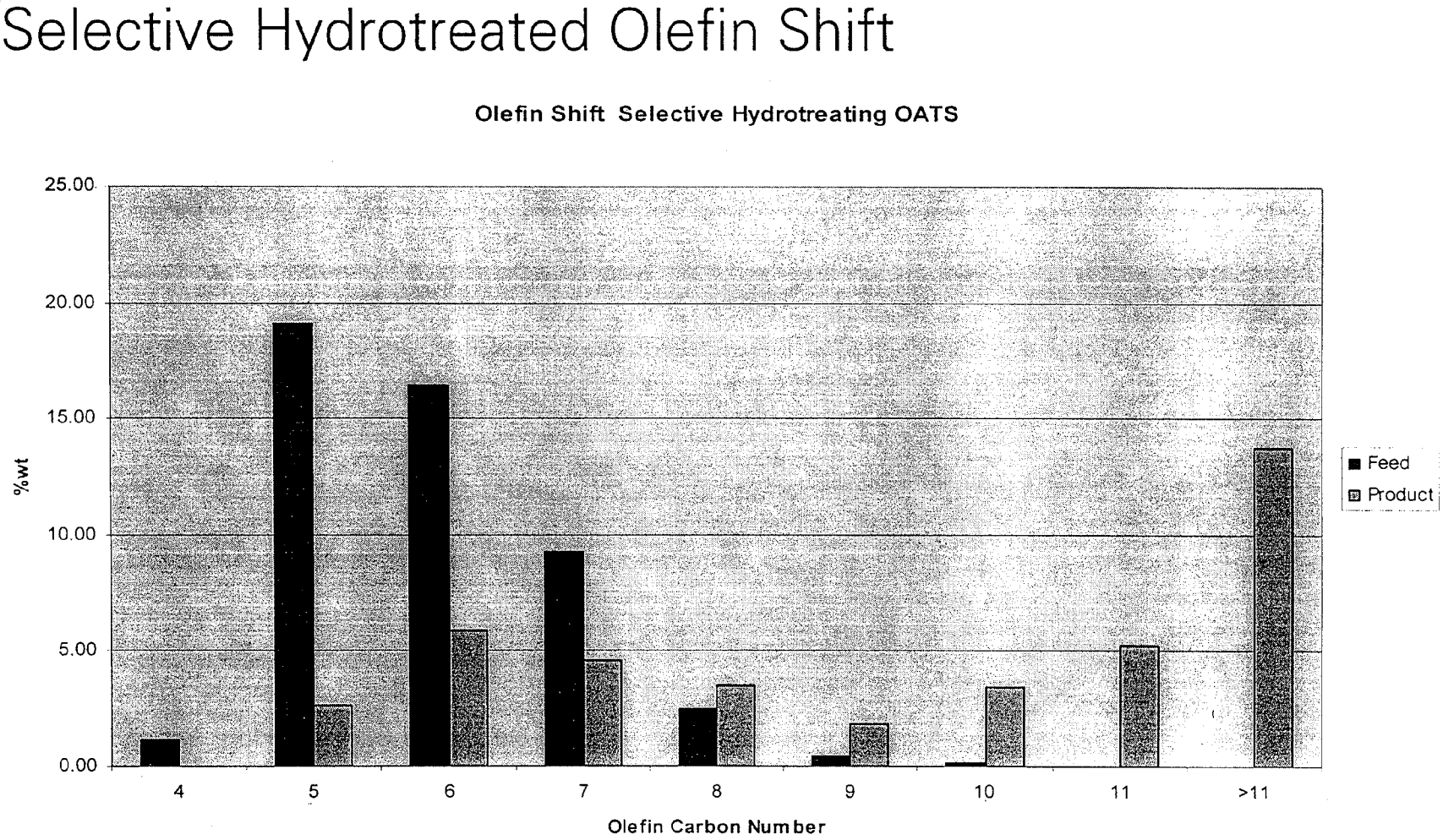
Figure 3:
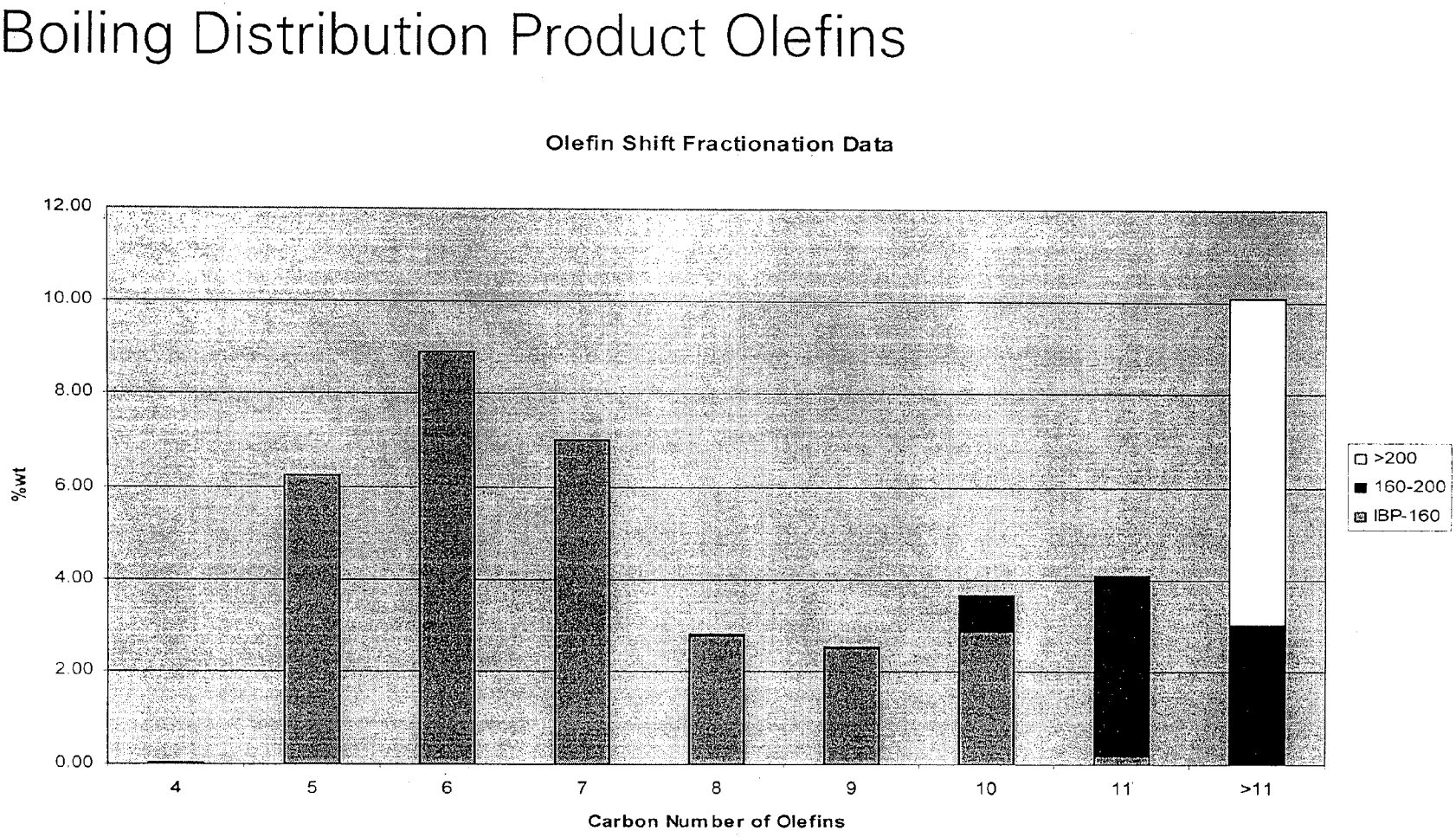
Figure 4:
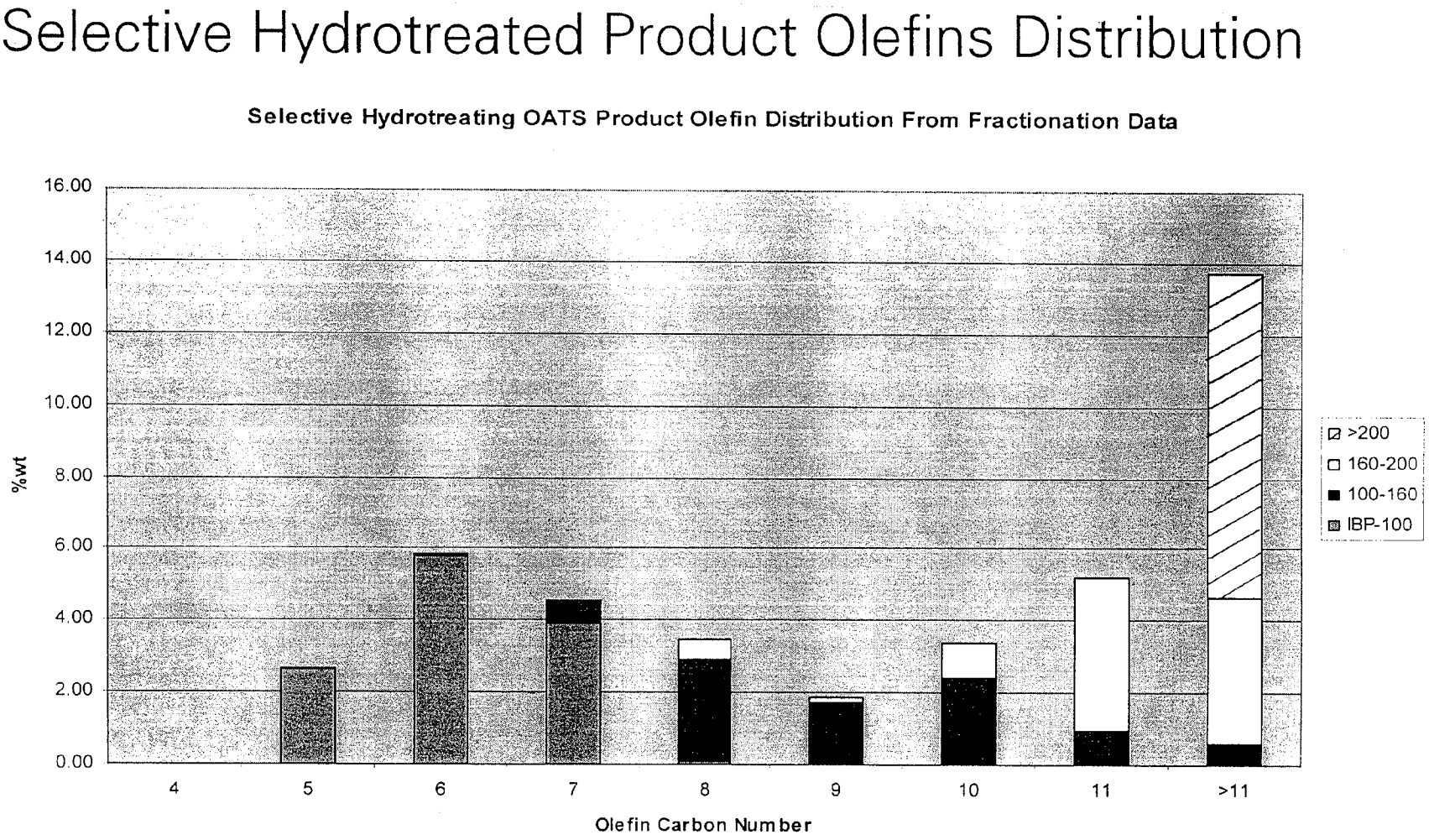
Figure 5:
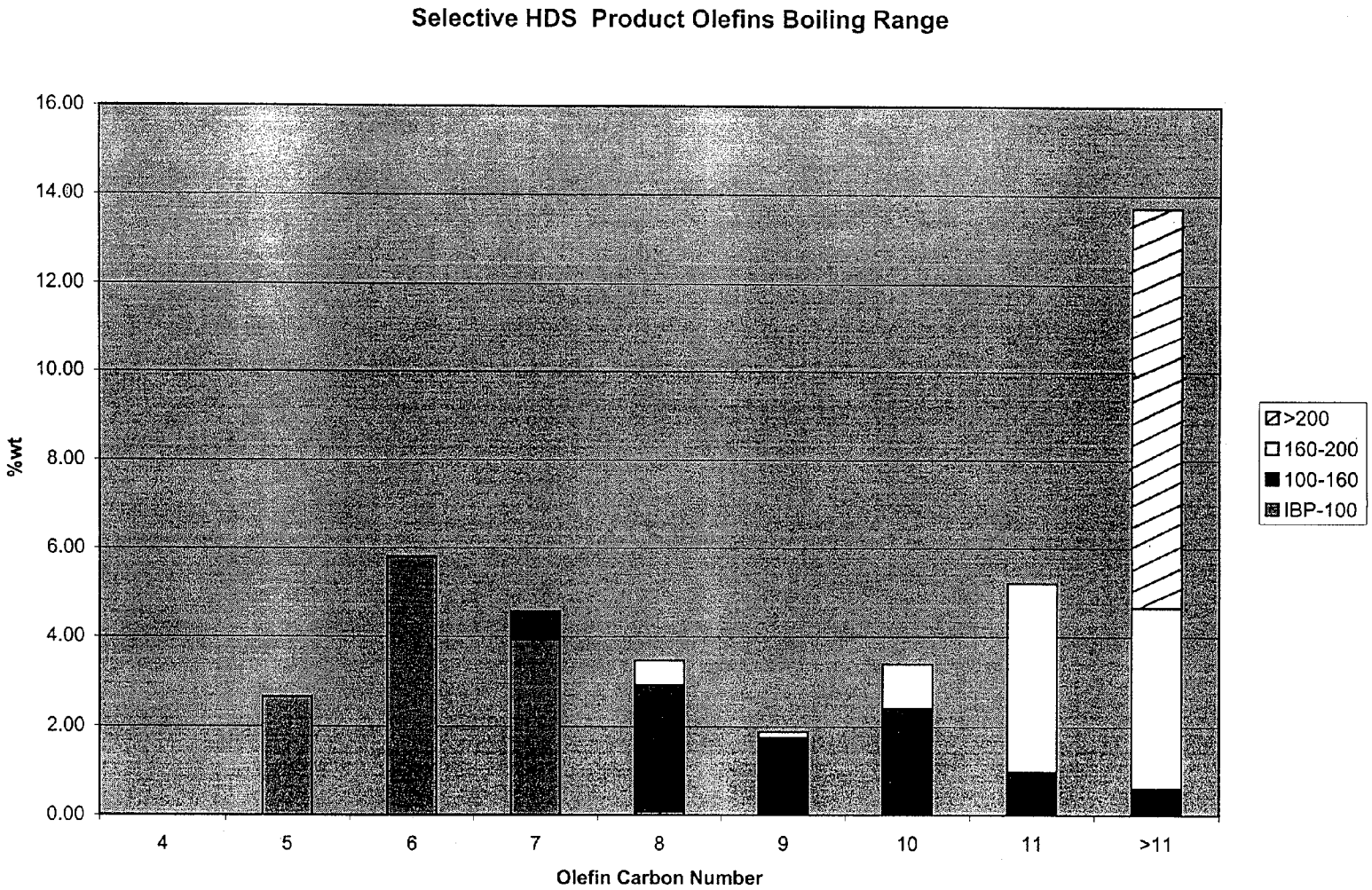

As used herein, the terms "sulfur-containing aromatic compound" and "sulfur-containing aromatic impurity" refer to any aromatic organic compound which contains at least one sulfur atom in its aromatic ring system. Such materials include thiophenic and benzothiophenic compounds, and examples of such material include but are not limited to thiophene, 2-methylthiophene, 3-methylthiophene, 2,3-dimethylthiophene, 2,5-dimethylthiophene, 2-ethylthiophene, 3-ethylthiophene, benzothiophene, 2-methylbenzothiophene, 2,3-dimethylbenzothiophene, and 3-ethylbenzothiophene.

Suitable hydrocarbons for used in this invention are derived from petroleum distillates which generally comprise most refinery streams consisting substantially of hydrocarbon compounds which are liquid at ambient conditions. Petroleum distillates are liquids which boil over either a broad or a narrow range of temperatures within the range from about 10° C. to about 345° C. However, such liquids are also encountered in the refining of products from coal liquefaction and the processing of oil shale or tar sands. These distillate feedstocks can range as high as 2.5 percent by weight elemental sulfur but generally range from about 0.1 percent by weight to about 0.9 percent by weight elemental sulfur. The higher sulfur distillate feedstocks are generally virgin distillates derived from high sulfur crude, coker distillates, and catalytic cycle oils from fluid, catalytic cracking units processing relatively higher sulfur feedstocks. Nitrogen content of distillate feedstocks in the present invention is also generally a function of the nitrogen content of the crude oil, the hydrogenation capacity of a refinery per barrel of crude capacity, and the alternative dispositions of distillate hydrogenation feedstock components. The higher nitrogen distillate feedstocks are generally coker distillate and the catalytic cycle oils. These distillate feedstocks can have total nitrogen concentrations ranging as high as 2000 ppm, but generally range from about 5 ppm to 20 about 900 ppm.

Suitable refinery streams generally have an API gravity ranging from about 10° API to about 100° API, preferably from about 10 ° API to about 75 or 100° API, and more preferably from about 15° API to about 50° API for best results. These streams include, but are not limited to, fluid catalytic process naphtha, fluid or delayed process naphtha, light virgin naphtha, hydrocracker naphtha, hydrotreating process naphthas, isomerate, and catalytic reformate, and combinations thereof. Catalytic reformate and catalytic cracking process naphthas can often be split into narrower boiling range streams such as light and heavy catalytic naphthas and light and heavy catalytic reformate, which can be specifically customized for use as a feedstock in accordance with the present invention. The preferred streams are light virgin naphtha, catalytic cracking naphthas including light and heavy catalytic cracking unit naphtha, catalytic reformate including light and heavy catalytic reformate and derivatives of such refinery hydrocarbon streams.

In aspects of the invention where an olefin or a mixture of olefins is used as the alkylating agent, olefin polymerization will also compete, as an undesired side reaction, with the desired alkylation of sulfur-containing impurities. As a consequence of this competing reaction, it is frequently not possible to achieve high conversion of the sulfur-containing impurities to alkylation products without a significant conversion of olefinic alkylating agent to polymeric co-products. Such a loss of olefins can be very undesirable as, for example, when an olefinic naphtha of gasoline boiling range is to be desulfurized and the resulting product used as a gasoline blending stock. In this case, olefins having from about 6 to about 10 carbon atoms, which olefins are of high octane and in the gasoline boiling range, can be converted to high-boiling polymeric by-products under severe alkylation conditions and thereby lost as gasoline components.

More suitable feedstocks for used in this invention include any of the various complex mixtures of hydrocarbons derived from refinery distillate steams which generally boil in a temperature range from about 50° C. to about 425° C. Generally such feedstock are comprised of a mixture of hydrocarbons, but contain a minor amount of sulfur-containing organic impurities including aromatic impurities such as thiophenic compounds and benzothiophenic compounds. Preferred feedstocks have an initial boiling point which is below about 79° C. and have a distillation endpoint which is about 345° C. or lower, and more preferably about 249° C. or lower. If desired, the feedstock can have a distillation endpoint of about 221° C. or lower.

It is also anticipated that one or more of the above distillate steams can be combined for use as a feedstock. In many cases performance of the refinery transportation fuel or blending components for refinery transportation fuel obtained from the various alternative feedstocks may be comparable. In these cases, logistics such as the volume availability of a stream, location of the nearest connection and short term economics may be determinative as to what stream is utilized.

Products of catalytic cracking are highly preferred feedstocks for use in this invention. Feedstocks of this type include liquids which boil below about 345° C., such as light naphtha, heavy naphtha and light cycle oil. However, it will also be appreciated that the entire output of volatile products from a catalytic cracking process can be utilized as a feedstock in the subject invention. Catalytic cracking products are a desirable feedstock because they typically contain a relatively high olefin content, which usually makes it unnecessary to add any additional alkylating agent during the first alkylation stage of the invention. In addition to sulfur-containing organic compounds, such as mercaptans and sulfides, sulfur-containing aromatic compounds, such thiophene, benzothiophene and derivatives of thiophene and benzothiophene, are frequently a major component of the sulfur-containing impurities in catalytic cracking products, and such impurities are easily removed by means of the subject invention. For example, a typical light naphtha from the fluidized catalytic cracking of a petroleum derived gas oil can contain up to about 60 percent by weight of olefins and up to about 0.5 percent by weight of sulfur wherein most of the sulfur will be in the form of thiophenic and benzothiophenic compounds. A preferred feedstock for use in the practice of this invention will be comprised of catalytic cracking products and will be additionally comprised of at least 1 weight percent of olefins. A highly preferred feedstock will be comprised of catalytic cracking products and will be additionally comprised of at least 5 weight percent of olefins. Such feedstocks can be a portion of the volatile products from a catalytic cracking process which is isolated by distillation.

In the practice of this invention, the feedstock will contain sulfur-containing aromatic compounds as impurities. In one embodiment of the invention, the feedstock will contain both thiophenic and benzothiophenic compounds as impurities. If desired, at least about 50% or even more of these sulfur-containing aromatic compounds can be converted to higher boiling sulfur-containing material in the practice of this invention. In one embodiment of the invention, the feedstock will contain benzothiophene, and at least about 50% of the benzothiophene will be converted to higher boiling sulfur-containing material by alkylation and removed by fractionation.

Any acidic material which exhibits a capability to enhance the alkylation of sulfur-containing aromatic compounds by olefins or alcohols can be used as a catalyst in the practice of this invention. Although liquid acids, such as sulfuric acid can be used, solid acidic catalysts are particularly desirable, and such solid acidic catalysts include liquid acids which are supported on a solid substrate. Solid acidic catalysts are generally preferred over liquid catalysts because of the ease with which the feed can be contacted with such a material. For example, feedstream can simply be passed through one or more fixed beds of solid particulate acidic catalyst at a suitable temperature. As desired, different acidic catalysts can be used in the various stages of the invention. For example, the severity of the alkylation conditions can be moderated in the alkylation step of the subsequent stage through the use of a less active catalyst, while a more active catalyst can be used in the alkylation step of the initial stage.

Catalysts useful in the practice of the invention include acidic materials such as catalysts comprised of acidic polymeric resins, supported acids, and acidic inorganic oxides. Suitable acidic polymeric resins include the polymeric sulfonic acid resins which are well-known in the art and are commercially available. Amberlyst® 35, a product produced by Rohm and Haas Co., is a typical example of such a material.

Supported acids which are useful as catalysts include but are not limited to Brönsted acids (examples include phosphoric acid, sulfuric acid, boric acid, HF, fluorosulfonic acid, trifluoro-methanesulfonic acid, and dihydroxyfluoroboric acid) and Lewis acids (examples include $BF_3$, $BCl_3$, $AlCl_3$, $AlBr_3$, $FeCl_2$, $FeCl_3$, $ZnCl_2$, $SbF_5$, $SbCl_5$ and combinations of $AlCl_3$ and HCl) which are supported on solids such as silica, alumina, silica-aluminas, zirconium oxide or clays.

U.S. Pat. No. 2,921,081 (Zimmerschied et al.), which is incorporated herein by reference in its entirety, discloses the preparation of solid phosphoric acid catalysts by combining a zirconium compound selected from the group consisting of zirconium oxide and the halides of zirconium with an acid selected from the group consisting of ortho-phosphoric acid, pyrophosphoric acid and triphosphoric acid. U.S. Pat. No. 2,120,702 (Ipatieff et al.), which is incorporated herein by reference in its entirety, discloses the preparation of a solid phosphoric acid catalyst by combining a phosphoric acid with a siliceous material.

British Patent No. 863,539, which is incorporated herein by reference in its entirety, also discloses the preparation of a solid phosphoric acid catalyst by depositing a phosphoric acid on a solid siliceous material such as diatomaceous earth or kieselguhr. When a solid phosphoric acid is prepared by depositing a phosphoric acid on kieselguhr, it is believed that the catalyst contains; (i) one or more free phosphoric acid, i.e., ortho-phosphoric acid, pyrophosphoric acid or triphosphoric acid, and (ii) silicon phosphates which are derived from the chemical reaction of the acid or acids with the kieselguhr. While the anhydrous silicon phosphates are believed to be inactive as an alkylation catalyst, it is also believed that they can be hydrolyzed to yield a mixture of ortho-phosphoric and polyphosphoric acids which are catalytically active. The precise composition of this mixture will depend upon the amount of water to which the catalyst is exposed.

In order to maintain a solid phosphoric acid alkylation catalyst at a satisfactory level of activity when it is used with a substantially anhydrous hydrocarbon feedstock, it is conventional practice to add a small amount of an alcohol, such as isopropyl alcohol, to the feedstock to maintain the catalyst at a satisfactory level of hydration. It is believed that the alcohol undergoes dehydration upon contact with the catalyst, and that the resulting water then acts to hydrate the catalyst. If the catalyst contains too little water, it tends to have a very high acidity which can lead to rapid deactivation as a consequence of coking and, in addition, the catalyst will not possess a good physical integrity. Further hydration of the catalyst serves to reduce its acidity and reduces its tendency toward rapid deactivation through coke formation. However, excessive hydration of such a catalyst can cause the catalyst to soften, physically agglomerate and create high pressure drops in fixed bed reactors. Accordingly, there is an optimum level of hydration for a solid phosphoric acid catalyst, and this level of hydration will be a function of the reaction conditions, the substrate, and the alkylating agent.

In preferred embodiments of the invention using solid phosphoric acid catalysts, a hydrating agent in an amount which exhibits a capability to enhance performance of the catalyst is required. Advantageously, the hydrating agent is at least one member of the group consisting of alkanols having from about 2 to about 5 carbon atoms. An amount of hydrating agent which provides a water concentration in the feedstock in the range from about 50 to about 1,000 parts per million is generally satisfactory. This water is conveniently provided in the form of an alcohol such as isopropyl alcohol.

As stated previously, feedstocks used in the practice of this invention will likely contain nitrogen-containing organic compounds as impurities in addition to the sulfur-containing organic impurities. Many of the typical nitrogen-containing impurities are organic bases and, in some instances, can cause deactivation of the acidic catalyst or catalysts of the subject invention. Such deactivation can be prevented by removal of the basic nitrogen-containing impurities before they can contact the acidic catalyst. These basic impurities are most conveniently removed from the feedstock before it is utilized in the initial alkylation stage. A highly preferred feedstock for use in the invention is comprised of a treated naphtha which is prepared by removing basic nitrogen-containing impurities from a naphtha produced by a catalytic cracking process.

DESCRIPTION OF THE PREFERRED EMBODIMENTS

Typically, a gas oil which contains hydrocarbon compounds, sulfur-containing organic compounds, and nitrogen-containing organic compounds as impurities is catalytically cracked in a fluidized catalytic cracking process to obtain added value products such as light naphthas which also contain olefins (alkenes).

The light naphtha feedstock is comprised of organic compounds which include hydrocarbon compounds, such as paraffins, olefins, naphthenes, aromatics, and the impurities (sulfur-containing organic compounds and nitrogen-containing organic compounds). Advantageously, the light naphtha feedstock also contains an amount of alkenes in the range of from about 10 percent to about 30 percent based upon the total weight of the feedstock. More generally, the amount of alkenes in suitable light naphtha feedstocks may as low as about 5 percent, or as high as about 50 percent.

However, the light naphtha feedstock also contains up to about 2,500 parts per million by weight sulfur, preferably from about 200 parts per million to about 1000 parts per million by weight sulfur, in the form of sulfur-containing organic compounds which include thiophene, thiophene derivatives, benzothiophene, benzothiophene derivatives, mercaptans, sulfides and disulfides. Typically, feedstock also contains basic nitrogen containing organic compounds as impurities. Advantageously, the amount of basic nitrogen in suitable feedstock is in a range downward from about 30 parts per million to about zero.

At least a portion of the basic nitrogen containing compounds are removed from the feedstock through contact with an acidic material in pretreatment unit, for example using an aqueous solution of sulfiric acid, beneficially under mild contacting conditions which do not cause any significant chemical modification of the hydrocarbon components of the feedstock.

The treated feedstock is passed through at least one reactor, where it contacts the acidic catalyst under reaction conditions which are effective to convert predominately the thiophenic impurities to higher boiling thiophenic materials through alkylation by the olefins. In general, the effective conditions of reaction depend upon the catalyst employed. For embodiments using an acidic catalyst comprising a solid phosphoric acid material in the initial alkylation reactor, the contacting is carried out at temperatures in a range from about 90° C. to about 250° C., preferably at temperatures in a range from about 100° C. to about 235° C., and more preferably at temperatures in a range from about 110° C. to about 220° C.

Where a second state of alkylation desired the temperature of the effluent stream is reduced by a pre-selected amount of at least 5° C. The temperature differential between the initial alkylation stage and the subsequent stage preferably is in a range of from about negative 5° C. to about negative 115° C., more preferably in a range from about negative 15° C. to about negative 75° C.

The effluent stream at the reduced temperature passes through a downstream alkylation reactor, which contains an acidic catalyst. The effluent stream is passed through reactor, where it contacts the acidic catalyst under reaction conditions which are effective to convert predominately the mercaptans and sulfides impurities to higher boiling materials through alkylation by the olefins. In general, the effective conditions of reaction depend upon the catalyst employed. For embodiments using an acidic catalyst comprising a solid phosphoric acid material in the initial alkylation reactor, the contacting is carried out at temperatures preferably in range from about 75° C. to about 200° C., more preferably at temperatures in range from about 90° C. to about 150° C. most preferably at temperatures in range from about 100° C. to about 130° C. for best results.

The alkylated stream passes from the final alkylation reactor into a distillation column where the higher boiling sulfur-containing products of the alkylation reactions are separated from a low boiling fraction, which thereby is of reduced sulfur content. The low boiling fraction, which is of reduced sulfur content relative to the sulfur content of the first feedstock fraction and has a distillation endpoint of about 177° C. This low boiling fraction is a preferred low sulfur blending component of the invention. Typically, the sulfur content of this low boiling fraction is less than about 50 parts per million, preferably less than about 30 parts per million and more preferably less than about 15 parts per million.

A high boiling fraction, which has an initial boiling point of about 177° C. and contains the high boiling alkylated sulfur-containing material produced in alkylation reactor. This high boiling material is conveyed to a hydrotreating unit for removal of at least a portion of its sulfur content.

A gaseous mixture containing dihydrogen (molecular hydrogen) is supplied to a catalytic reactor of the hydrotreating unit from storage or a refinery source. Typically, the catalytic hydrotreating reactor contains one or more fixed bed of the same or different catalyst which have a hydrogenation-promoting action for desulfurization of the high boiling material. The reactor may be operated in up-flow, down-flow, or counter-current flow of the liquid and gases through the bed.

The extent of hydrogenation is dependent upon several factors which include selection of catalyst and conditions of reaction, and also the precise nature of the sulfur-containing organic impurities in the high boiling material. The conditions of reaction are desirably selected such that at least about 50 percent of the sulfur content of the sulfur-containing organic impurities is converted to hydrogen sulfide, and preferably so that the conversion to hydrogen sulfide is at least about 75 percent.

Typically a fixed bed of suitable catalyst is used in the catalytic reactor under conditions such that relatively long periods elapse before regeneration becomes necessary, for example an average reaction zone temperature of from about 50° C. to about 450° C., preferably from about 75° C. to about 255° C., and most preferably from about 200° C. to about 200° C. for best results, and at a pressure within the range of from about 6 to about 160 atmospheres. One or more beds of catalyst and subsequent separation and distillation operate together as an integrated hydrotreating and fractionation system. This system separates unreacted dihydrogen, hydrogen sulfide and other non-condensable products of hydrogenation from the effluent stream.

After removal of hydrogen sulfide, product is transferred from hydrotreating unit to storage or a refinery blending unit. Typically, the sulfur content of this product is less than about 50 parts per million, preferably less than about 30 parts per million and more preferably less than about 15 parts per million. If desired the resulting liquid mixture of condensable compounds is fractionated into a low-boiling fraction containing a minor amount of remaining sulfur and a high-boiling fraction containing a major amount of remaining sulfur.

EXAMPLES OF THE INVENTION

The following Examples will serve to illustrate certain specific embodiments of the herein disclosed invention. These Examples should not, however, be construed as limiting the scope of the novel invention as there are many variations which may be made thereon without departing from the spirit of the disclosed invention, as those of skill in the art will recognize.

Example 1

This example illustrates formation of alkylated aromatic compounds of the invention. The feedstock is very light and therefore well separated from products. The major olefins in the feedstock are listed, and these give rise to the major high molecular weight aromatic products, likely by electrophylic addition. A detailed break down of the olefins in the feedstock and alkylated product is given in Table 1.

Examples 2-7

These examples illustrate a gasoline fuel composition of the invention. Table II presents PIANO analysis of both the low-sulfur fraction (100-) component of the gasoline fuel composition of the invention and the fraction (100-) of the alkylation feedstock used in blending of the reference fuel.

Table III presents selected properties of both the low-sulfur fraction (100-) component of the gasoline fuel composition of the invention and the fraction (100-) of the alkylation feedstock used in blending of the reference fuel Table IV presents blend compositions and selected properties of both the gasoline fuel composition of the invention and the reference fuel.

Table V presents inspection results for both the gasoline fuel composition of the invention and the reference fuel.

Table VI presents a summary analysis of both the gasoline fuel composition of the invention and the reference fuel as measured by ASTM D1319(1995).

Table VII presents the results of the M102E inlet system cleanliness test for both the gasoline fuel composition of the invention and the reference fuel. Results of side-by-side engine testing of the gasoline fuel composition of the invention and a reference fuel with Mercedes M-102-E protocol, demonstrate a very significant reduction of valve deposit. In particular, the valve deposits using the reference fuel averaged 14.7 mg, but were only 3.4 mg using the gasoline fuel composition of the invention.

Examples of Feedstock Alkylation

General

The pilot-scale unit included two identical fixed-bed reactors which were operated in a serial down-flow mode with inter-reactor cooling of the process stream. Each reactor was charged with 300 mL of catalyst. The process stream flowed into the first reactor of the two reactor unit through a feed weigh tube, precision metering pump (Zenith), high pressure feed pump (Whitey), and an external preheater. Each reactor was disposed within a furnace equipped with six heating zones. Temperatures were measured along the centerline of each catalyst bed by thermocouples in various positions, and the heating zones were adjusted accordingly. An inter-reactor sampling system was located between the two reactors allowing the liquid process stream to be sampled at operating conditions.

During operation, the process stream was charged into the first reactor of the two reactor unit through a feed weigh tube, precision metering pump (Zenith), high pressure feed pump (Whitey), and an external preheater. The total effluent from the first reactor was transferred into the second reactor. The liquid product from the second reactor flowed into a high pressure separator where nitrogen was used to maintain the outlet pressure of the second reactor at the desired operating pressure. Level of the liquid in the separator was maintained by an Annin control valve.

In these examples of the invention, the naphtha feedstock, boiling over the range from about 61° C. to about 226° C., was obtained by fractional distillation of the products from the fluidized catalytic cracking of a gas oil feedstock which contained sulfur-containing impurities. Analysis of the naphtha feedstock using a multi-column gas chromatographic technique showed it to contain on a weight basis: 42.5 percent olefins (7.75 percent cyclic olefins), 15.6 percent aromatics, and 32.3 percent paraffins (9.41 percent cyclic paraffins). This naphtha feedstock was admixed with isopropyl alcohol to provide feedstock having an alkanol level of 240 parts per million.

Except were stated otherwise, the catalyst used for the examples was a solid phosphoric acid catalyst (C84-5-01 supplied by Sud Chemie, Inc., Louisville, Ky., USA) which was crushed to a Tyler screen mesh size of −12+20 (USA Standard Testing Sieve by W. S. Tyler).

Unless otherwise indicated, percentages and parts per million (ppm) are on the bases of an appropriate weight.

Example 8

In this example of the invention the two reactors were charged with the solid phosphoric acid catalyst having particle sizes Tyler screen mesh −12+20, and operated at a liquid hourly space velocity of 1.5 $hr^{-1}$. Reactor one was maintained at a temperature of about 172° C., and reactor two at a temperature of about 122° C., i.e., a temperature differential between the serial reactors of negative 50° C. Analysis of the process stream is shown in Table VIII. The reduction in the total of 2-methyl and 3-methyl thiophenes was from about 254 ppm to about 3 ppm, a reduction of about 98.8 percent. The total of C2-thiophenes was reduced from about 125 ppm to about 29 ppm, a reduction of 76.8 percent. The reduction in the total of all sulfur compounds boiling at temperatures below 110° C. was from about 184 ppm to about 5.7 ppm, a reduction of 96.9 percent.

Comparative Example

In this example, as in Example 8, the two reactors were charged with the solid phosphoric acid catalyst having particle sizes Tyler screen mesh −12+20, and operated at a liquid hourly space velocity of 1.5 $hr^{-1}$. However, reactor one was maintained at a temperature of about 121° C., and reactor two at a temperature of about 172° C., i.e., a temperature differential between the serial reactors of positive 51° C. Analysis of the process stream is shown in Table IX. The reduction in the total of 2-methyl and 3-methyl thiophenes was from about 254 ppm to about 5.42 ppm, a reduction of about 97.8 percent. The total of C2-thiophenes was reduced from about 125 ppm to about 43.16 ppm, a reduction of about 65.5 percent. The reduction in the total of all sulfur compounds boiling at temperatures below 110° C. was from about 184 ppm to about 20.52 ppm, a reduction of only about 88.8 percent.

In the comparative example the level of all sulfur compounds boiling at temperatures below 110° C. was, importantly, 3.58 times greater than in Example 1 of the invention.

For the purposes of the present invention, "predominantly" is defined as more than about fifty percent. "Substantially" is defined as occurring with sufficient frequency or being present in such proportions as to measurably affect macroscopic properties of an associated compound or system. Where the frequency or proportion for such impact is not clear, substantially is to be regarded as about twenty percent or more. The term "essentially free of" is defined as absolutely except that small variations which have no more than a negligible effect on macroscopic qualities and final outcome are permitted, typically up to about one percent.

TABLE 1

FORMATION OF ALKYLATED BENZENES

| OLEFIN HYDROCARBON | FEEDSTOCK ANALYSIS, wt. percent | ALKYLATED FEEDSTOCK ANALYSIS, wt. percent | PERCENT CONVERSION |
|---|---|---|---|
| trans-Butene-2 | 0.41 | 0.04 | 90.19 |
| cis-Butene-2 | 0.57 | 0.02 | 96.47 |
| Pentene-1 | 1.58 | 0.12 | 92.37 |
| 2-Methyl-butene-1 | 3.80 | 0.12 | 96.83 |
| trans-Pentene-2 | 3.85 | 1.29 | 66.59 |
| cis-Pentene-2 | 2.19 | 0.48 | 77.97 |
| 2-Methyl-butene-2 | 6.92 | 0.71 | 89.69 |
| 2-Methyl-pentene-1 | 1.18 | 0.25 | 78.81 |
| trans-Hexene-2 | 1.42 | 1.15 | 19.31 |
| 2-Methyl-pentene-2 | 1.83 | 0.94 | 48.37 |
| cis-Pentene-2 | 1.82 | 0.95 | 47.54 |
| Total | 27.76 | 6.07 | |

TABLE II

GC PIANO ANALYSIS

| Type of Hydrocarbons Having 4 to 11 Carbon Atoms | Percent by Volume of Low-Sulfur Fraction (100−) | Percent by Volume of Feedstream Fraction (100−) |
|---|---|---|
| Saturated Naphtas | 7.87 | 6.38 |
| Saturated iso-Paraffins | 54.24 | 36.98 |
| Saturated n-Paraffins | 6.93 | 5.35 |
| Unsaturated Naphtas | 1.01 | 4.4 |
| Unsaturated iso-Paraffins | 18.23 | 29.9 |
| Unsaturated n-Paraffins | 9.69 | 15.19 |
| Aromatic Hydrocarbons | 1.97 | 1.65 |
| Total | 99.93 | 99.85 |

TABLE III

PROPERTIES OF DISTILLATE FRACTIONS (100−)

| TEST | Low-Sulfur Fraction (100−) | Feedstream Fraction (100−) |
|---|---|---|
| RON | 91.1 | 93.6 |
| MON | 82. | 80.9 |
| RON/2 + MON/2 | 86.55 | 87.25 |
| RVP, psi | 13.3 | 12.23 |
| IBP, ° C. | 28.4 | 31.6 |
| 5 mL, ° C. | 37.2 | 40.6 |
| 95 mL, ° C. | 83.8 | 83.7 |
| FBP, ° C. | 110.8 | 110.6 |

RON is road octane number.
MON is motor octane number.
RVP is vapor pressure in units of pounds per square inch.
IBP is initial boiling point temperature as measured by ASTM D86.
FBP is final boiling point temperature as measured by ASTM D86.

TABLE IV

COMPOSITIONS AND PROPERTIES OF GASOLINE FUEL BLENDS

| ITEM | TEST BLEND | REFERENCE BLEND |
|---|---|---|
| Low-Sulfur Fraction, vol. % | 45 | 0 |
| Feedstream Fraction, vol. % | 0 | 33 |
| Alky., vol. % | 10 | 12.5 |
| Cat. ref., vol. % | 40 | 38.5 |
| It/hyd, vol. % | 0 | 16 |

TABLE IV-continued

COMPOSITIONS AND PROPERTIES OF GASOLINE FUEL BLENDS

| ITEM | TEST BLEND | REFERENCE BLEND |
|---|---|---|
| ptn., vol. % | 5 | 0 |
| IBP, ° C. | 32 | 30.5 |
| FBP, ° C. | 178.5 | 175.5 |

RON is road octane number measured by EN 25164 (1993)
MON is motor octane number measured by EN 25163 (1993).
IBP is initial boiling point temperature as measured by ASTM D86.
FBP is final boiling point temperature as measured by ASTM D86.

TABLE V

INSPECTION RESULTS FOR GASOLINE FUEL BLENDS

| ITEM | TEST BLEND | REFERENCE BLEND |
|---|---|---|
| Density, Kg/L | 0.7393 | 0.7346 |
| RON | 96.0 | 96.7 |
| MON | 85.3 | 85.5 |
| RVP, Kpa | 61.6 | 62.3 |
| IBP, ° C. | 32 | 30.5 |
| FBP, ° C. | 178.5 | 175.5 |
| Carbon Content, % | 87 | 86.7 |
| Hydrogen Content, % | 13 | 13.26 |

RON is road octane number measured by EN 25164 (1993)
MON is motor octane number measured by EN 25163 (1993).
RVP is vapor pressure in units of K Pascal.
IBP is initial boiling point temperature as measured by ASTM D86.
FBP is final boiling point temperature as measured by ASTM D86.

TABLE VI

ANALYSIS OF GASOLINE FUEL BLENDS ASTM D1319 (1995)

| HYDROCARBONS | TEST BLEND | REFERENCE BLEND |
|---|---|---|
| Olefins, vol. % | 13.3 | 16.8 |
| Saturates, vol. % | 54.9 | 52.9 |
| Aromatics, vol. % | 31.8 | 30.3 |

TABLE VII

M102E INLET SYSTEM CLEANLINESS TEST RESULTS FOR GASOLINE FUEL BLENDS

| ITEM | TEST BLEND | REFERENCE BLEND |
|---|---|---|
| CRC Visual Ratings, upper inlet system | 9.0 | 8.9 |
| CRC Visual Ratings, inlet valve tulip, ave of 4 Cyl | 9.8 | 9.7 |
| Inlet valve deposit weights | | |
| Cylinder 1, mg | 5.4 | 5.0 |
| Cylinder 2, mg | 0.5 | 27.0 |
| Cylinder 3, mg | 6.3 | 14 |
| Cylinder 4, mg | 1.4 | 14 |
| Average valve Deposits, mg | 3.4 | 14.7 |

Test and reference blends were treated with 330 mL/m$^3$ of BASF fuel additive Keropur K3540 K5.

TABLE VIII

ANALYSIS OF THE PROCESS STREAMS FOR SERIAL REACTORS UNDER A TEMPERATURE DIFFERENTIAL OF NEGATIVE 50° C.

| Sulfur Compound | Reactor One Feed, ppm | Reactor Two Feed, ppm | Product, ppm |
|---|---|---|---|
| feed | 53.0 | 16 | 15 |
| methyl mercaptan | 0.97 | 0 | 0 |
| ethyl mercaptan | 29.4 | 0.30 | 0.28 |
| n-propyl mercaptan | 0 | 0.37 | 0.20 |
| isopropyl mercaptan | 7.39 | 1.24 | 0.89 |
| n-butyl mercaptan | 0 | 1.67 | 1.52 |
| 2-methyl,1-propanethiol | 1.48 | 0.12 | 0 |
| 2-methyl,2-propanethiol | 1.23 | 0.18 | 0.12 |
| amyl mercaptan | 0 | 0.41 | 0.13 |
| methyl sulfide | 0.85 | 0.43 | 0.41 |
| carbon disulfide | 0.23 | 0.38 | 0.18 |
| ethyl methyl sulfide | 2.3 | 1.08 | 0.9 |
| tetrahydrathiophene | 28.3 | 12.9 | 9.12 |
| thiophene | 117.6 | 1.7 | 1 |
| C1-T | 253.58 | 5.8 | 3.1 |
| C2-T | 124.97 | 38.17 | 28.83 |
| S < 110° C. | 184.06 | 7.58 | 5.73 |

C1-T is a total of 2-methyl thiophenes and 3-methyl thiophenes.

C2-T is a total of C2 thiophenes.

S < 110° C. is a total of all sulfur compounds boiling at temperatures below 110° C.

TABLE IX

ANALYSIS OF THE PROCESS STREAMS FOR SERIAL REACTORS UNDER A TEMPERATURE DIFFERENTIAL OF POSITIVE 51° C.

| Sulfur Compound | Reactor One Feed, ppm | Reactor Two Feed, ppm | Product, ppm |
|---|---|---|---|
| feed | 53.0 | 9 | 24 |
| methyl mercaptan | 0.97 | 0 | 0 |
| ethyl mercaptan | 29.4 | 0.21 | 1.25 |
| n-propyl mercaptan | 0 | 0.26 | 1.19 |
| isopropyl mercaptan | 7.39 | 0.46 | 2.20 |
| n-butyl mercaptan | 0 | 2.03 | 4.11 |
| 2-methyl,1-propanethiol | 1.48 | 0.11 | 0.20 |
| 2-methyl,2-propanethiol | 1.23 | 0.18 | 0.41 |
| amyl mercaptan | 0 | 0.14 | 0.27 |
| methyl sulfide | 0.85 | 0.51 | 0.62 |
| carbon disulfide | 0.23 | 0.24 | 0.33 |
| ethyl methyl sulfide | 2.3 | 1.22 | 1.48 |
| tetrahydrathiophene | 28.3 | 21.2 | 10.39 |
| thiophene | 117.6 | 12.8 | 2.38 |
| C1-T | 253.58 | 28.23 | 5.42 |
| C2-T | 124.97 | 60.31 | 43.16 |
| S < 110° C. | 184.06 | 16.21 | 20.52 |

C1-T is a total of 2-methyl thiophenes and 3-methyl thiophenes.

C2-T is a total of C2 thiophenes.

S < 110° C. is a total of all sulfur compounds boiling at temperatures below 110° C.

That which is claimed is:

1. A composition of fuel suitable for use in compression ignition internal combustion engines, which fuel comprises: as a predominant component a mixture of organic compounds exhibiting a suitable initial boiling point, and containing one or more aromatic compound represented by the formula

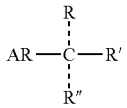

where Ar is an aryl moiety of 6 or 7 carbon atoms, R is hydrogen or an alkyl group of 1 or 2 carbon atoms, and R' and R" are each an independently selected alkyl group of from 1 to 4 carbon atoms, the aromatic compounds represented by the formula are from about 0.01 percent to about 20 percent by weight of all aromatic compounds in the fuel, and wherein the fuel exhibits a suitable flash point of at least 38° C. as measure by ASTM D93, a suitable Reid vapor pressure at least 6 psi, and contains less than 50 ppm sulfur.

2. The composition according to claim 1 further comprising an effective amount of one or more Diesel fuel additives selected from the group consisting of copolymers of ethylene and vinyl acetate, which enhance cold flow properties Diesel fuel.

3. The composition according to claim 1 wherein the aromatic compounds represented by the formula comprise at least one aryl moiety selected from the group consisting of benzo, tolyl, phenyl and phenylene.

4. The composition according to claim 1 wherein the total number of carbon atoms in R, R' and R" is from 4 to 7 carbon atoms.

5. The composition according to claim 1 wherein the total amount of aromatic compounds in the fuel is no more than 35 percent by volume, and the amount of alkene compounds in the fuel is no more than 15 percent by volume.

6. The composition according to claim 1 wherein the total amount of aromatic compounds in the fuel is no larger than 25 percent by volume, and the amount of alkene compounds in the fuel is no more than 6 percent by volume.

7. The composition according to claim 1 wherein the aromatic compounds represented by the formula are in an amount of from about 0.01 percent to about 10 percent based upon the total weight of aromatic compounds in the fuel.

8. The composition according to claim 1 wherein the fuel exhibits a suitable flash point of at least 49° C.

9. The composition according to claim 1 further comprising an effective amount of one or more Diesel fuel additives selected from the group consisting of copolymers of ethylene and vinyl acetate, which enhances cold flow properties of Diesel fuel.

* * * * *